US005250873A

United States Patent [19]

McHugh

[11] Patent Number: 5,250,873

[45] Date of Patent: Oct. 5, 1993

[54] FILAMENT SUPPORT FOR TUBULAR LAMP CAPSULE

[75] Inventor: John F. McHugh, Rochester, Vt.

[73] Assignee: GTE Products Corporation, Danvers, Mass.

[21] Appl. No.: 815,004

[22] Filed: Dec. 27, 1991

[51] Int. Cl.[5] ..... H01K 1/24

[52] U.S. Cl. ..... 313/274; 313/271; 313/284; 313/286

[58] Field of Search ..... 313/271, 274, 579, 623, 313/284, 286

[56] References Cited

U.S. PATENT DOCUMENTS

| | | | |
|---|---|---|---|
| 1,565,600 | 3/1916 | Stoekle | 313/274 |
| 4,510,416 | 4/1985 | Meade et al. | 313/579 |
| 4,942,331 | 7/1990 | Bergman et al. | 313/274 |
| 4,959,858 | 10/1990 | Hoegler et al. | 313/271 |
| 5,079,475 | 1/1992 | Oortman Gerlings et al. | 313/274 |

*Primary Examiner*—Donald J. Yusko
*Assistant Examiner*—N. D. Patel
*Attorney, Agent, or Firm*—Joseph S. Romanow

[57] ABSTRACT

A filament support for supporting and centering a filament in a double-ended lamp envelope includes an inlead portion defining a central axis, a filament attachment portion and a centering portion interconnecting the inlead portion and the filament attachment portion. The centering portion includes first and second arcuate segments for contacting an inner surface of the lamp envelope. The first and second arcuate segments are axially spaced apart and are interconnected by an axial segment. Filament supports are connected to opposite ends of the filament for accurately centering the filament in the lamp envelope. The filament supports are particularly useful in a tubular incandescent lamp capsule having an infrared reflective coating on its outer surface.

9 Claims, 3 Drawing Sheets

FILAMENT SUPPORT FOR TUBULAR LAMP CAPSULE

FIELD OF THE INVENTION

This invention relates to tubular incandescent lamps and, more particularly, to filament supports for supporting and centering a filament in a double-ended lamp capsule.

BACKGROUND OF THE INVENTION

Tubular incandescent halogen lamps include a helical filament axially mounted within a quartz lamp envelope. Filament supports attached to the filament support and center the filament within the lamp envelope. The ends of the lamp envelope are hermetically sealed, typically by press sealing. Molybdenum foils electrically connect the filament through the seals to external electrical leads. The interior of the lamp envelope is typically filled with an inert gas and one or more halogen compounds.

It is important to center the filament within the lamp envelope to prevent undesired interactions between the filament and the walls of the lamp envelope. In addition, it is well known that for proper lamp performance, the spacing between coils of the filament must be precisely controlled. This is important because a slight change in filament length significantly changes the operating temperature of the filament. Any change in filament temperature will have a dramatic effect on lamp performance and life.

In one particular lamp type, filament location is even more critical. This type of lamp is known as an infrared conserving lamp, which has a wavelength selective filter coating applied to the outside surface of the lamp envelope. A central region of the lamp envelope adjacent to the filament typically has a geometrically shaped section such as ellipsoidal. The selective filter coating transmits visible radiation and reflects infrared radiation back to the filament. The reflected infrared radiation can significantly reduce the electrical power consumption of the lamp. In order to gain maximum benefit from the reflected infrared radiation, the filament must be very precisely centered on the axis of the lamp envelope. Also, in order for the filament to perform at its design temperature, the filament length must be precisely controlled.

An important component of the tubular incandescent lamp capsule described above is the filament support used to support and center each end of the filament and to conduct electrical energy to the filament. Filament supports for tubular incandescent lamps are disclosed in U.S. Pat. No. 4,942,331 issued Jul. 17, 1990 to Bergman et al; U.S. Pat. No. 4,510,416 issued Apr. 9, 1985 to Meade et al and U.S. Pat. No. 4,959,585 issued Sept. 25, 1990 to Hoegler et al. Factors involved in the design of filament supports include the requirement for easy insertion in a tubular lamp envelope, which may vary in inside diameter from lamp to lamp, the requirement for accurate centering of the filament over the life of the lamp and the requirement to maintain the filament at a predetermined length throughout the life of the lamp.

It is a general object of the present invention to provide improved tubular incandescent lamp capsules.

It is another object of the present invention to provide improved filament supports for tubular incandescent lamp capsules.

It is a further object of the present invention to provide filament supports for accurate and stable centering of a filament within a tubular incandescent lamp capsule.

It is yet another object of the present invention to provide filament supports for tubular incandescent lamp capsules which are easy to manufacture and which are low in cost.

SUMMARY OF THE INVENTION

According to the present invention, these and other objects and advantages are achieved in a filament support for supporting and centering a filament in a double-ended lamp envelope. The filament support comprises an inlead portion defining a central axis, a filament attachment portion and a centering portion interconnecting the inlead portion and the filament attachment portion. The centering portion includes first and second arcuate segments for contacting an inner surface of the lamp envelope. The first and second arcuate segments are axially spaced apart and are interconnected by an axial segment.

The inlead portion is interconnected to the first arcuate segment, and the filament attachment portion is interconnected to the second arcuate segment. In a preferred embodiment, the inlead portion, the filament attachment portion and the centering portion comprise a single length of refractory wire. Preferably, the first and second arcuate segments are in planes generally perpendicular to the central axis, are generally circular and comprise less than a full circle.

According to another aspect of the invention, there is provided a lamp capsule comprising a light-transmissive lamp envelope having seals at opposite ends thereof and having a central axis, a filament within the lamp envelope, first and second filament supports connected to opposite ends of the filament for supporting and centering the filament on the central axis of the lamp envelope, and means for coupling electrical energy through the seals to the first and second filament supports. The first and second filament supports are configured as described above.

BRIEF DESCRIPTION OF THE DRAWINGS

For a better understanding of the present invention, together with other and further objects, advantages and capabilities thereof, reference is made to the accompanying drawings which are incorporated herein by reference and in which.

DESCRIPTION OF THE PRIOR ART

Figure 1:
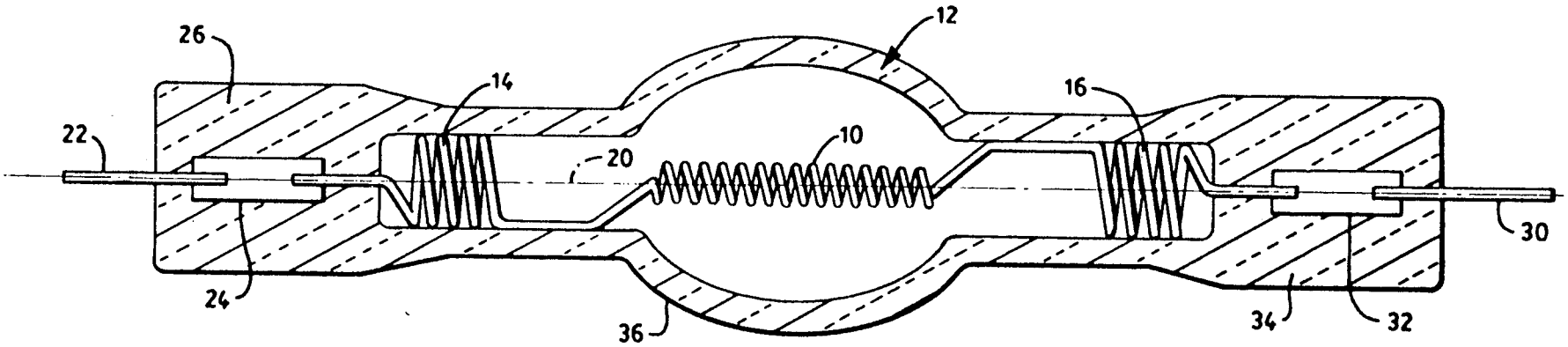
FIG. 1 PRIOR ART
FIG. 1 shows a tubular incandescent lamp capsule in accordance with the prior art.

A tubular incandescent lamp capsule in accordance with the prior art is shown in FIG. 1. A helically coiled filament 10 is mounted within a tubular lamp envelope 12. The filament 10 is supported at each end by filament supports 14 and 16. The filament supports 14 and 16 center the filament 10 on a central axis 20 of lamp envelope 12. Filament support 14 is electrically connected to an external lead 22 by a molybdenum foil conductor 24 which passes through a seal 26. Filament support 16 is electrically connected to an external lead 30 by a molybdenum foil conductor 32 which passes through a seal 34. Seals 26 and 34 hermetically seal the lamp envelope 12. An infrared reflective coating 36 is applied to the outside surface of the lamp envelope 12. Helical portions of filament supports 14 and 16 engage the inner surface of lamp envelope 12 and center filament 10 on axis 20.

DETAILED DESCRIPTION OF THE INVENTION

Figure 2A:
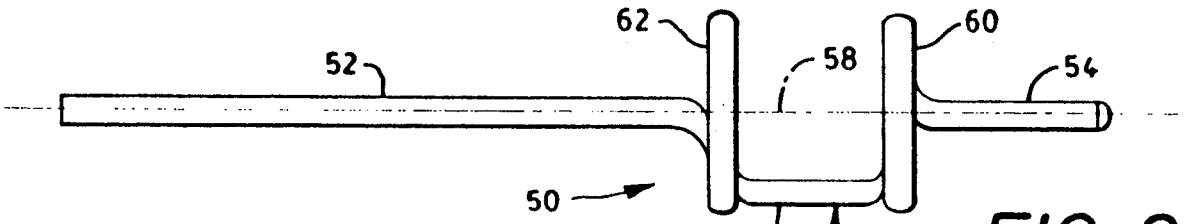
FIGS. 2A-2C show front, side and top views, respectively, of the filament support of the present invention.
Figure 2B:
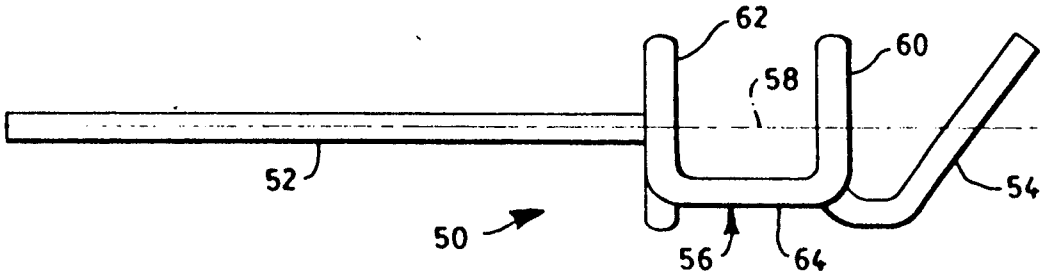
Figure 2C:
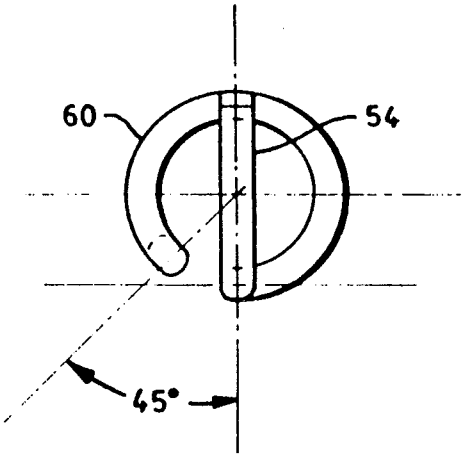

A filament support in accordance with the present invention is shown in FIGS. 2A-2C. A filament support 50 includes an inlead portion 52, a filament attachment portion 54 and a centering portion 56. The filament support 50 has a central axis 58. The filament attachment portion 54 extends through the central axis 58 at an angle, as best shown in FIG. 2B. The centering portion 56 interconnects inlead portion 52 and filament attachment portion 54, and provides support and accurate centering of the filament.

The centering portion 56 includes a first arcuate segment 60 and a second arcuate segment 62. The arcuate segments 60 and 62 are axially spaced apart and are interconnected by an axial segment 64. As used herein, "axial segment" refers to a segment of the filament support that is generally parallel to axis 58. The inlead portion 52 is connected to one end of arcuate segment 62, and the filament attachment portion 54 is connected to one end of arcuate segment 60. The axial segment 64 interconnects the other ends of arcuate segments 60 and 62.

The arcuate segments 60 and 62 are generally circular in shape and comprise less than a full circle. The arcuate segments 60 and 62 preferably comprise about 60 to 90% of a full circle. In a preferred embodiment, the arcuate segments 60 and 62 each comprise a 315° portion of a circle.

The arcuate segments 60 and 62 define partial circular regions for contact with the inside surface of a cylindrical lamp envelope. The contact regions are axially spaced apart by the length of axial segment 64. The outside diameters of arcuate segments 60 and 62 are dimensioned to match the inside diameter of a tubular lamp envelope less an allowance for arc tube inside diameter variations.

The filament support 50 is preferably fabricated from a single length of electrically conductive refractory wire such as molybdenum, but other materials, such as tungsten, may also be suitable. The wire must have sufficient strength to support the filament and must have a diameter that is sufficient to carry the lamp current. A molybdenum wire diameter of 0.013 inch, for example, is suitable for lamp currents of one amp or less. The wire is formed into the required shape by a four-slide wire forming machine. In a preferred embodiment, the filament support 50 has an overall length of 0.5 inch, and the centering portion 56 is dimensioned to fit with minimum clearance in a lamp envelope having an inside diameter of 0.116 inch.

Figure 3:
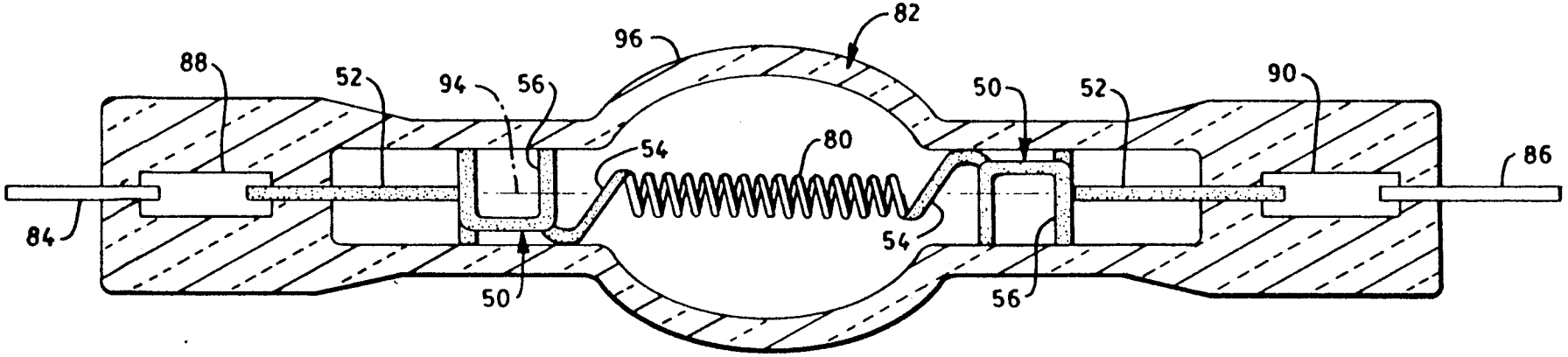
FIG. 3 shows a tubular incandescent lamp capsule incorporating the filament support of FIGS. 2A-2C.

A double-ended, tubular incandescent lamp capsule incorporating filament supports 50 is shown in FIG. 3. A helically coiled filament 80 is supported within a double-ended tubular lamp envelope 82, typically quartz, by filament supports 50. The filament attachment portions 54 are attached to filament 80 by one of several methods, as known in the art, such as crimping or welding. In the resulting subassembly, the two filament supports and the filament all share a common axis. The inlead portions 52 are connected to external leads 84 and 86 by molybdenum foil conductors 88 and 90, respectively, which pass through seals at opposite ends of lamp envelope 82. The centering portions 56 of filament supports 50 contact the inner cylindrical walls of the lamp envelope 82 to accurately center filament 80 on a central axis 94 of lamp envelope 82. The lamp envelope 82 has an infrared reflective coating 96 on its outer surface. Techniques for fabrication and sealing of lamp envelopes and for application of infrared reflective coating 96 are known in the art.

As indicated above, it is important for proper operation of tubular incandescent lamp capsules that the filament be accurately centered within the lamp envelope and have a desired spacing between turns of the filament coils. These parameters are particularly important in the infrared conserving lamp which has an infrared reflective coating on its outer surface. The filament supports shown and described above are dimensioned to fit the inside diameter of the lamp envelope relatively closely. However, due to the large variation of the inside diameter of the lamp envelope from lamp to lamp, the filament support must be sized a few thousandths of an inch smaller than the nominal inside diameter of the lamp envelope. It will be recognized that the lack of an intimate fit between the filament supports and the lamp envelope can result in variations in position of the filament relative to the lamp envelope. The lack of intimate fit between the filament supports and the lamp envelope is preferably overcome by a process known as "tacking". The tacking process shrinks the lamp envelope around the filament supports, thereby creating an intimate locking fit and securing the filament in a fixed position relative to the lamp envelope.

The tacking process is performed during the lamp making process. First the lamp envelope is mounted in a holding fixture. Then a filament assembly, including a helical filament with a filament support attached to each end, is positioned within the lamp envelope. The ends of the filament assembly are secured in separately movable holding fixtures which can be moved both radially and axially. Next, the axial and radial positions of the filament are determined using a calibrated measurement system such as a vision system. When the actual filament position differs from the desired filament position, the filament position is corrected by moving the holding fixtures. When the correct filament location and stretch are established, the exterior of the lamp envelope is locally heated with a torch in a region adjacent to the filament support. The heating causes the lamp envelope to soften and collapse around the filament support. During the heating operation and for a short cooling time thereafter, the interior of the lamp envelope is flushed with an inert gas or a reducing gas to prevent oxidation of the interior metal parts. Preferably, the interior of the lamp envelope is flushed with argon or nitrogen, sometimes blended with small quantities of hydrogen. If necessary, the internal pressure of the lamp envelope can be reduced to facilitate the collapse of the lamp envelope around the filament support. Alternatively, mechanical pressure can be applied to the heated area of the lamp envelope to facilitate collapse of the lamp envelope around the filament support. Preferably, mechanical pressure is applied by counter-opposed metal jaws. In any case, the lamp envelope in the heated region collapses around the filament support and secures it in position after cooling. The relative positions of the filament and the lamp envelope are maintained by the holding fixtures until the lamp envelope has cooled.

The tacking process can be performed sequentially at each end of the lamp envelope, or both ends can be tacked simultaneously. In still another variation, only one end of the lamp envelope is tacked. In this version, one end of the lamp is sealed, such as by press sealing or vacuum sealing. Then, the opposite end of the lamp is adjusted and tacked as described above. In this variation, the sealing operation provides sufficient anchoring of the filament support to eliminate the need for tacking at that end.

When the glass or quartz lamp envelope is collapsed around the filament support, it is not necessary for the glass or quartz to be adhered to the filament support. Mechanical entrapment is generally sufficient to maintain filament position. Filament supports 50 described above are designed to contact the inner surface of the lamp envelope at two arcuate, axially spaced-apart contact regions. This configuration of the filament supports facilitates positioning of the filament by tacking. When the lamp envelope is heated and collapses around the filament support, the lamp envelope contacts the filament support at the arcuate contact regions defined by arcuate segments 60 and 62. In addition, the lamp envelope material can deform into the spaces between arcuate segments 60 and 62, thereby securely holding the filament supports after cooling. By contrast, prior art helical filament supports do not have sufficient spaces between contact points to permit deformation of the lamp envelope. As a result, prior art helical filament supports are less securely held after the tacking process. Further details regarding the tacking process are provided in application Ser. No. 07/814,739 entitled Methods for Mounting Filaments in Tubular Incandescent Lamp Capsules), filed concurrently herewith, which is hereby incorporated by reference.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A filament support for supporting and centering a filament in a double-ended lamp envelope, comprising:

an inlead portion defining a central axis of said filament support;

a filament attachment portion; and a centering portion interconnecting the inlead portion and the filament attachment portion, said centering portion including first and second arcuate segments for contacting an inner surface of the lamp envelope, said first and second arcuate segments being axially spaced apart and interconnected by a linear axial segment.

2. A filament support as defined in claim 1 wherein said inlead portion is interconnected to said first arcuate segment and wherein said filament attachment portion is interconnected to said second arcuate segment.

3. A filament support as defined in claim 1 wherein said inlead portion, said filament attachment portion and said centering portion comprise a single length of refractory wire.

4. A filament support as defined in claim 2 wherein said first and second arcuate segments are in planes generally perpendicular to said central axis.

5. A filament support as defined in claim 4 wherein said first and second arcuate segments are generally circular and comprise less than a full circle.

6. A lamp capsule comprising:

a light-transmissive lamp envelope having seals at opposite ends thereof and having a central axis;

a filament within said lamp envelope;

first and second filament supports connected to opposite ends of said filament for supporting and centering said filament on the central axis of said lamp envelope; and means for coupling electrical energy through said seals to said first and second filament supports, said first and second filament supports each comprising an inlead portion attached to said coupling means, a filament attachment portion attached to said filament and a centering portion interconnecting the inlead portion and the filament attachment portion, said centering portion including first and second arcuate segments for contacting an interior surface of the lamp envelope, said first and second arcuate segments being axially spaced apart and interconnected by a linear axial segment.

7. A lamp capsule as defined in claim 6 wherein said inlead portion is interconnected to said first arcuate segment and wherein said filament attachment portion is interconnected to said second arcuate segment.

8. A lamp capsule as defined in claim 7 wherein said first and second arcuate segments are in planes generally perpendicular to said central axis.

9. A lamp capsule as defined in claim 8 wherein said first and second arcuate segments are generally circular and comprise less than a full circle.

* * * * *